US011427915B2

(12) United States Patent
Haumesser et al.

(10) Patent No.: US 11,427,915 B2
(45) Date of Patent: Aug. 30, 2022

(54) METHOD FOR METALLISING A POROUS STRUCTURE MADE OF CARBON MATERIAL

(71) Applicant: COMMISSARIAT A L'ENERGIE ATOMIQUE ET AUX ENERGIES ALTERNATIVES, Paris (FR)

(72) Inventors: Paul-Henri Haumesser, Saint Cassein (FR); Jean Dijon, Champagnier (FR); Raphael Ramos, Seyssinet-Pariset (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 0 days.

(21) Appl. No.: 16/217,228

(22) Filed: Dec. 12, 2018

(65) Prior Publication Data

US 2019/0186017 A1 Jun. 20, 2019

(30) Foreign Application Priority Data

Dec. 19, 2017 (FR) ..... 1762512

(51) Int. Cl.

| | |
|---|---|
| ***C23C 18/40*** | (2006.01) |
| ***C23C 18/16*** | (2006.01) |
| ***C23C 18/34*** | (2006.01) |
| ***C23C 18/52*** | (2006.01) |
| ***C23C 18/31*** | (2006.01) |
| ***C23C 18/44*** | (2006.01) |

(52) U.S. Cl.

CPC ..... *C23C 18/40* (2013.01); *C23C 18/1639* (2013.01); *C23C 18/1644* (2013.01); *C23C 18/1682* (2013.01); *C23C 18/31* (2013.01); *C23C 18/34* (2013.01); *C23C 18/44* (2013.01); *C23C 18/52* (2013.01)

(58) Field of Classification Search

CPC ..... C23C 18/31; C23C 18/32; C23C 18/34; C23C 18/36; C23C 18/38; C23C 18/40; C23C 18/405; C23C 18/42; C23C 18/44; C23C 18/48; C23C 18/50; C23C 18/52; C23C 18/54; C23C 18/16

See application file for complete search history.

(56) References Cited

U.S. PATENT DOCUMENTS 2,819,188 A * 1/1958 Metheny ..... C23C 18/36 427/438
3,635,761 A * 1/1972 Haag ..... C23C 18/44 427/99.5
7,538,062 B1 5/2009 Dai et al.
2011/0266504 A1* 11/2011 Fransaer ..... C23C 18/31 252/512
2012/0219735 A1* 8/2012 Bakker ..... B01J 20/06 428/34.1
2013/0217279 A1* 8/2013 Hemond ..... H01R 4/188 439/878
2014/0369005 A1 12/2014 Gavillet et al.
2018/0115014 A1 4/2018 Zanotti et al.

OTHER PUBLICATIONS

Subramaniam, Nano-scale, planar and multi-tiered current pathways from a carbon nanotube-copper composite with high conductivity, ampacity and stability, Feb. 2016, Nanoscale, vol. 8, p. 3888-3894 (Year: 2016).*

Barriere, Copper nanopaticles and organometallic chemical liquid deposition for substrate metallization, 2008, J. Mater. Chem, vol. 18, p. 3084-3086 (Year: 2008).*

Preliminary French Search Report for Application No. 1762512, dated Aug. 30, 2018.

Darwich et al., "An Efficient, Versatile, and Safe Access to Supported Metallic Nanoparticles on Porous Silicon with Ionic Liquids", International Journal of Molecular Sciences, vol. 17, No. 6, Jun. 3, 2016, pp. 1-9.

Darwich et al., "Impact of Surface Chemistry on Copper Deposition in Mesoporous Silicon," American Chemical Society, 2016, 32, pp. 7452-7458.

Hsu et al., "Aniline as a Dispersant and Stabilizer for the Preparation of Pt Nanoparticles Deposited on Carbon Nanotubes", Journal of Physical Chemistry C, vol. 114, No. 17, 2010, pp. 7933-7939.

Subramaniam et al., "Nano-scale, planar and multi-tiered current pathways from a carbon nanotube-copper composite with high conductivity, ampacity and stability", Nanoscale, DOI: 10.1039/c5nr03762j, Oct. 8, 2015.

* cited by examiner

*Primary Examiner* — Dah-Wei D. Yuan
*Assistant Examiner* — Nga Leung V Law
(74) *Attorney, Agent, or Firm* — Pearne & Gordon LLP

(57) ABSTRACT

Method for metallising a porous structure made of carbon material, the method comprising the following steps: supplying a porous structure made of carbon material, immersing the porous structure in a solution comprising an ionic liquid, formed by a cation and an anion, and a metal precursor, placing the porous structure in a vacuum, immersed in the solution, in such a way as to cause the solution to penetrate into the porosity of the porous structure, adding a hydrogenated reducing agent, in such a way as to metallise the porous structure to within the porosity of the porous structure.

19 Claims, 2 Drawing Sheets

METHOD FOR METALLISING A POROUS STRUCTURE MADE OF CARBON MATERIAL

CROSS-REFERENCE TO RELATED APPLICATIONS

This application claims priority from French Patent Application No. 17 62512, filed Dec. 19, 2017. The content of this application is incorporated herein by reference in its entirety.

DESCRIPTION

Technical Field and Prior Art

This invention relates to a method for metallising a porous structure made of carbon material, such as a carbon nanotube structure.

The depositing of metal on or in carbon nanotubes (CNTs) is widely studied in literature in order to modify their properties, add new functionalities to them, or create CNT/metal composite materials.

The metallisation, partial or complete, internal or external, of nanotubes makes it possible to modify the physical-chemical properties of nanotubes (for example via a doping by charge transfer or a grafting of clusters or of metal nanoparticles) and is of interest for a certain number of applications such as heterogeneous catalysis or the conversion of energy in fuel cells or the creating of conductive materials with a nanotube base.

The complete metallisation of a network of nanotubes can result in the formation of a nanotube/metal composite material. These nanotubes/metal composites are particularly interesting for creating interconnections in microelectronics (conductive material with a high ampacity), or thermal interface materials for the packaging of integrated circuits and thermal management in power electronics.

The CNTs can be in dispersed form, in the form of a cable of braided CNTs or fixed to a substrate. In this latter case, they can be attached to the substrate, in the vertical or horizontal position, for example in order to create interconnection structures.

The metallisation is carried out by plunging the CNTs in a solution containing a metal salt or an organometallic complex, which is then chemically or electrochemically reduced. The electrochemical method offers better control on the quality and the morphology of the metal deposit, but requires being able to electrically connect the CNTs to an external generator, for example via an electrically conductive substrate, which limits its application scope.

Regardless of the method of deposition chosen, the main difficulty is linked to the hydrophobic character of CNTs. It is difficult to place them in a suspension in aqueous mediums and/or to deeply wet the mat or the braid of CNTs.

To overcome this, it is possible to add chemical compounds that have a strong affinity with CNTs. For example, in the article of Hsu et al. ("*Aniline as a Dispersant and Stabilizer for the Preparation of Pt Nanoparticles Deposited on Carbon Nanotubes*", J. Phys. Chem. C, 2010, 114, 7933-7939), carbon nanotubes are dispersed in a water/isopropanol solution containing aniline. $Pt^{4+}$ ions are then added in the presence of sodium citrate, a reducing agent. After filtration, and heating to 400° C. under a stream of $H_2$, carbon nanotubes covered with platinum particles are obtained. The aniline, in addition to its strong affinity with CNTs, also makes it possible to prevent the agglomeration of the platinum.

However, this solution requires using additional reagents and/or to treat the waste coming from these methods, which generates an additional cost.

Another solution, described, for example, in the article of Subramaniam et al. ("*Nano-scale, planar and multi-tiered current pathways from a carbon nanotube—copper composite with high conductivity, ampacity and stability*", Nanoscale, DOI: 10.1039/c5nr03762j) consists in depositing copper electrolytically on the carbon nanotubes. For this, an electrolyte with an acetonitrile base and containing $Cu(CH_3COO)_2$ is used, so as to best wet the CNTs. A thermal reduction at 250° C., under a stream of $H_2$, is then carried out.

However, it is indicated that when the nanotube structure is dense, it is difficult to cover the nanotubes to the core of the structure. In addition, it is necessary to treat the organic waste coming from this method, which generates an additional cost.

The same issues are found for other carbon substrates, for example for the porous carbon layers (carbon black for example) in the electrodes of fuel cells that must be impregnated with catalytic nanoparticles.

DISCLOSURE OF THE INVENTION

It is, consequently, a purpose of this invention to propose a method that makes it possible to metallise a porous structure made of carbon material to the core of the structure.

This purpose is achieved by a method for metallising a porous structure made of carbon material, said method comprising the following steps:

a) supplying a porous structure made of carbon material, b) immersing the porous structure in a solution comprising an ionic liquid, formed by a cation and an anion, and a metal precursor, c) placing the porous structure in a vacuum, immersed in the solution, in such a way as to cause the solution to penetrate into the porosity of the porous structure, d) adding a hydrogenated reducing agent, in such a way as to metallise the porous structure to within the porosity of the porous structure.

The invention is fundamentally distinguished from prior art by the use of a solution comprising an ionic liquid as a reaction medium and by the placing in a vacuum of the porous structure immersed in this solution. Ionic liquids have a low saturation vapour pressure, and can therefore easily be placed in a vacuum, without evaporating. The placing in a vacuum makes it possible to have the ionic liquid penetrate to the core of the structure, and therefore to metallise the structure as far as in the portions of the porosity that are the farthest from the outer surface of the structure. At the end of the method the structure is metallised, not only on the surface but also in the volume of the pores. Even the pores with small dimensions (typically having diameters less than 10 nm and even less than 5 nm even less than 2 nm) are metallised.

Advantageously, the metal precursor is a copper, platinum, palladium, iron, iridium, rhodium, ruthenium, nickel, cobalt, tantalum and/or silver precursor.

Advantageously, the metal precursor is a metal salt or an organometallic complex. The reducing agent makes it possible to hydrogenate the ligands of the organometallic complex, in order to make them more volatile, and eliminate them more easily, and/or to reduce the metal when the latter is not at an oxidation state (0).

Advantageously, the metal precursor is copper mesitylene.

Advantageously, the hydrogenated reducing agent is chosen from alcohols, gaseous hydrogen, hydrazine, sodium tetrahydridoborate and triethylsilane.

Advantageously, the placing in a vacuum is carried out at a pressure ranging from $10^{-7}$ bar to 10 mbar.

Advantageously, the placing in a vacuum is carried out for a duration ranging from 5 min to 4 h, preferably from 10 min to 30 min.

Advantageously, the step d) is carried out at a temperature ranging from 0° C. to 300° C., and preferably at a temperature ranging from 50° C. to 100° C. The choice of the temperature will depend on the metal precursor and/or on the ionic liquid.

According to a first advantageous alternative, the carbon material is chosen from carbon black, carbon nanofibres and a mixture of carbon nanotubes and fullerenes.

According to a second advantageous alternative, the carbon material comprises and, preferably, consists of carbon nanotubes.

Advantageously, the carbon nanotubes are at least partially open. It is possible to metallise the inner surface of the carbon nanotubes.

According to an advantageous alternative, the carbon nanotubes are in the form of a braid.

According to another advantageous alternative, the carbon nanotubes are in the form of a mat, arranged on a substrate, the carbon nanotubes being aligned perpendicularly to the substrate.

According to another advantageous alternative, the carbon nanotubes are in the form of a mat, arranged on a substrate, the carbon nanotubes being aligned parallel to the substrate.

BRIEF DESCRIPTION OF THE DRAWINGS

This invention shall be better understood based on the following description and accompanying drawings wherein.

DETAILED DESCRIPTION OF PARTICULAR EMBODIMENTS

Figure 1:
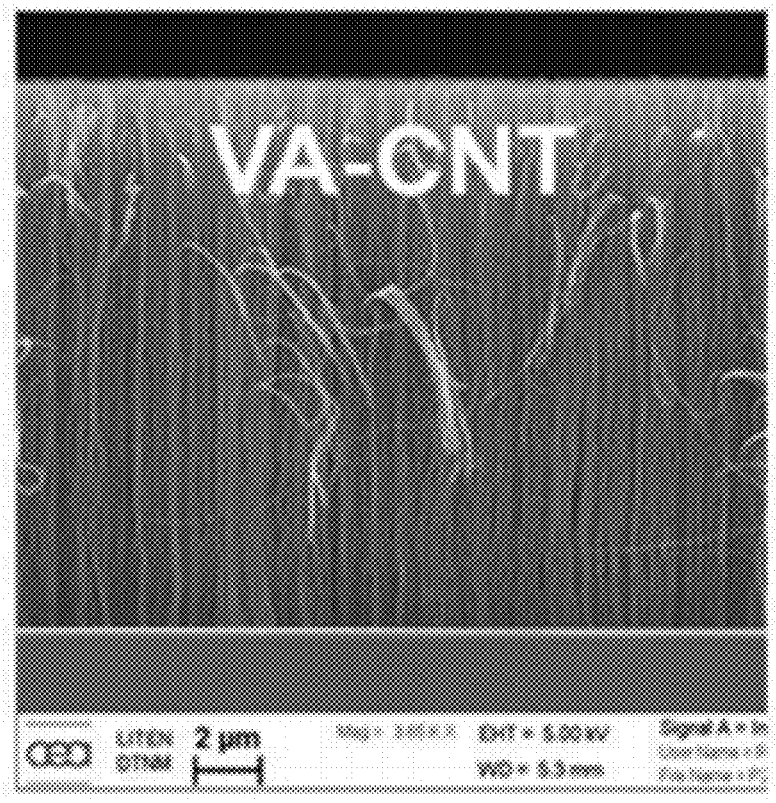
FIG. 1 is a snapshot obtained by scanning electron microscopy, of a porous structure of carbon nanotubes vertically aligned on a substrate, according to a particular embodiment of the invention.

In what follows, the metallisation of carbon nanotubes (CNTs) is described. However, the metallisation could relate to any type of carbon material, such as graphene, carbon black, carbon fibres or materials comprising a mixture of carbon nanotubes and fullerenes wherein the fullerenes are covalently bonded to the carbon nanotubes (materials also called "nanobuds"). These carbon materials have applications, for example, for fuel cells, or for forming conductive transparent thin layers.

The metallisation makes it possible to cover at least locally, and optionally totally the CNTs with a metal.

The metallisation can make it possible to create a doping by charge transfer of CNTs, or the synthesis of metal nanoparticles supported on CNTs, for fuel cell applications, for example for the purpose of an oxygen reduction reaction, heterogeneous catalysis, the conversion of energy in fuel cells or the creating of conductive materials with a nanotube base, such as cables with a nanotube base.

The complete metallisation of a network of nanotubes can result in the formation of a nanotube/metal composite material, particularly interesting for creating interconnections in microelectronics (conductive material with a high ampacity), or thermal interface material for the packaging of integrated circuits and thermal management in power electronics.

Porous Structure

The porous structure has, preferably, a porosity ranging from 10% to 80%, for example a porosity of 50%.

The pores of the structure are of small size (typically pore diameters less than 10 nm, preferably less than 5 nm and even more preferably less than 2 nm). The size of the pores of the carbon nanotube structure ranges, for example, from 0.5 nm to 10 nm.

The pores of the structure form an interconnected network. The pores are open on at least one of the outer surfaces of the structure.

The mass density of the structure ranges, for example, from 0.05 to 2 g/cm$^3$.

The structure can be composed of several unitary elements assembled together.

The porous structure is, preferably, made of carbon nano-objects.

The term nano-object means, for example, nanotubes, nanofibres or nanowires. Preferably, it is nanotubes.

Nanotubes have a one-dimensional shape: they have, advantageously, a form factor greater than or equal to 100, for example from 100 to 10,000. The form factor corresponds to the length/diameter ratio.

Nanotubes are, generally, structures that have a diameter of a few nanometres to a few tens of nanometres, and a length of a few hundred nanometres to a few hundred micrometres.

The diameter of the nanotubes ranges, advantageously, from 1 nm to 15 nm, preferably from 3 nm to 10 nm.

The average length of nanotubes ranges, advantageously, from 0.1 μm to 1,000 μm, and preferably from 5 μm to 300 μm.

Nanotubes can be closed at their ends. They can also be open at one of their ends or at both of their ends, which makes it possible to insert a metal inside.

Nanotubes can also be defective, i.e. they have at least one surface defect. This defect can be used as a nucleation site for the metal. It can possibly allow the ionic solution to access the inside of the nanotube and thus proceed with the internal metallisation of the nanotube.

Figure 2:
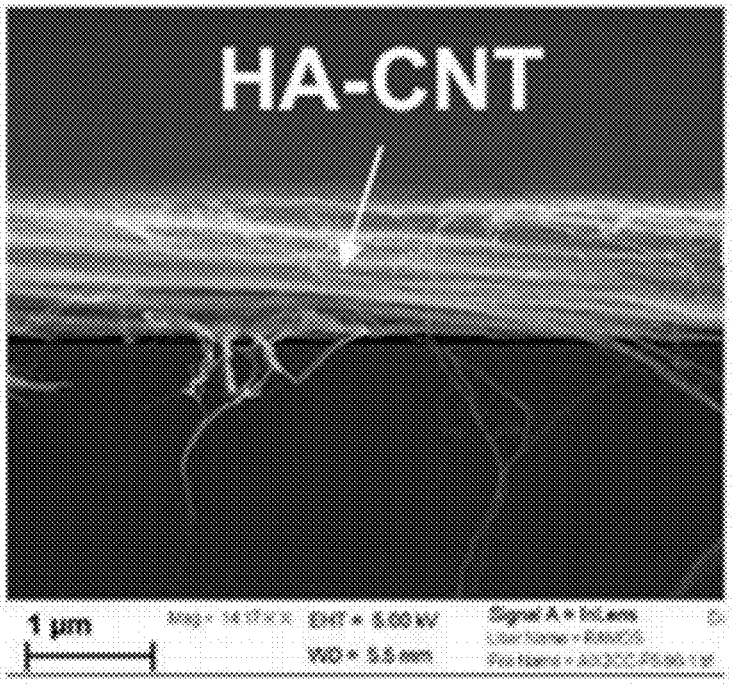
FIG. 2 is a snapshot obtained by scanning electron microscopy, of a porous structure of carbon nanotubes horizontally aligned on a substrate, according to a particular embodiment of the invention.

The nanotubes can be supported on a substrate (FIGS. 1 and 2).

For example, the nanotubes are arranged in the form of a mat of nanotubes, fixed to a substrate, in vertical position (FIG. 1). Nanotubes have a preferred orientation: they are aligned perpendicularly to the substrate. The thickness of the mat of nanotubes corresponds to the length of the nanotubes. The density of the nanotubes ranges, for example, from $10^9$ to $10^{13}$ nanotubes/cm$^2$, advantageously, it is greater than or equal to $10^{11}$ nanotubes/cm$^2$.

Nanotubes can also be lying on the substrate, i.e. they are parallel to the substrate, in the horizontal position (FIG. 2). The obtaining of lying nanotubes can be carried out by laying the nanotubes of a mat of nanotubes, for example with a roller. They are, preferably, lying in a given direction which will be that of the least electrical resistance. The use of lying nanotubes is particularly interesting for forming microelectronic interconnection structures.

The nanotubes can be formed directly on the substrate. According to an alternative they can also be transferred onto a substrate, after the manufacture thereof. They can weakly adhere to the substrate. The nanotubes can be aligned by using, for example, the method described in the article Adv. Funct. Mater. 2010, 20, 885-891. They can be deposited via a spray.

The substrate is, advantageously, inert with regards to the solution. It is, for example, made of silicon, or of a polymer, such as polycarbonate.

Nanotubes can also not be supported by a substrate. Nanotubes can be arranged in the form of a cable, obtained for example by braiding the nanotubes. This embodiment is interesting for creating electrical wires with a carbon nanotube base.

The Method of Metallising

The method of metallising carbon nanotubes comprises the following steps:

a) supplying a porous structure of carbon nanotubes, b) immersing the porous structure in a solution comprising an ionic liquid, formed by a cation and an anion, and a metal precursor, such as a metal salt or a metal complex, c) placing the porous structure in a vacuum, immersed in the solution, in such a way as to cause the solution to penetrate to the core of the porous structure, d) adding a hydrogenated reducing agent, in such a way as to reduce the metal precursor and to metallise the carbon nanotubes.

During the step b), the porous structure is plunged, at least partially, and preferably entirely, into the solution.

The solution has a low viscosity. It can have good ionic conductivity.

The solution comprises at least one ionic liquid. The solution can comprise a single ionic liquid or a mixture of several (two, three, etc.) ionic liquids.

The term ionic liquid means the association of at least one cation and one anion that generates a liquid with a melting temperature less than or in the vicinity of 100° C. The term solution means the presence of at least one ionic liquid. It can also be a mixture of several ionic liquids (two, three, etc.).

Using ionic liquid has many advantages in terms of chemistry, cost or method. Ionic liquids have substantial thermal stability, a vaporising pressure that is practically zero (they do not evaporate, even under a secondary vacuum), very low volatility, very low flammability and low surface tensions (they are good wetting agents). They have a very low melting point, often less than the ambient temperature.

Ionic liquids are not broken down during the method, which limits the cost of the method avoiding treatment of the solution after the metallisation. They can be recycled at the end of the reaction.

The ionic liquid is formed from one anion and from one cation.

Advantageously, the cation is chosen from an ammonia, an imidazolium, a pyrrolidinium, a phosphonium, a sulfonium and a piperidinium.

The imidazolium is, for example, 1-octyl-3-methyl-imidazolium also noted as C1C8Im, or 1-butyl-3-methyl-imidazolium also noted as C1C4Im. Ionic liquids with an imidazolium cation are the least viscous.

Advantageously, the anion is chosen from the halide anions, such as $Cl^-$, $Br^-$, $I^-$, amines, such as dicyanamides $N(CN)_2^-$ noted as $DCA^-$, tetrafluoroborate $BF_4^-$, hexafluorophosphate $PF_6^-$ and sulphur ligands such as thiocyanates $SCN^-$, bis(trifluoromethanesulfonyl)imide noted as $NTf2^-$, bis(fluorosulfonyl)imide $(FSO_2)_2N^-$ noted as $FSI^-$, trifluoromethanesulfonate or triflate $CF_3SO_3^-$, tris(pentafluoroethyl)trifluorophosphate noted as $FAP^-$ and bis(oxalato)borate noted as $BOB^-$.

The solution further comprises a metal precursor.

The metal precursor can be a copper, platinum, palladium, ruthenium, nickel, cobalt, iron, tantalum, iridium, rhodium and/or silver precursor.

This can be one or several metal salts and/or one or several metal complexes.

The term organometallic complex means a polyatomic structure wherein a metal element is bonded to one or several (two, three, or four, for example) organic ligands via coordination links.

There can be one metal element or more than one metal element in the organometallic complex, for example two identical metal elements (dimer). The metal element is, for example, a transition metal. It could be, according to an alternative, a noble or non-noble metal, a lanthanide or a rare earth element.

The organometallic complex can include the metal element under an oxidation state equal to 0 or different from 0, for example (I), (II), (III), (IV) or (V).

The ligand or ligands can be, for example, chosen from cyclooctadiene, cyclooctatriene, and β-diketones such as acetylacetone (AA), trifluoroacetyl-acetone (TAA), hexafluoroacetylacetone (HFA), thenoyltrifluoroacetone (TTA), 4,4-trifluoro-1-(2-thienyl)-1,3-butanedione (HTTA) and 1,5-cyclooctadiene-hexafluoroacetylacetone (COD-HFA). The ligand or ligands can also be chosen from dibenzylideneacetone, mesitylene, neopentyl, and Schrock Carbene (for example, $CHCMe_3$).

The metal and the ligands are chosen in such a way that the ligands facilitate the solubility of the metal in the ionic liquid. Advantageously, the ligands are also selected in such a way that their hydrogenation products do not contaminate the substrates and to be easily evaporated from the ionic liquid.

The metal precursor is, for example, copper mesitylene (CAS number 75732-01-3) or copper(II) Bis(trifluoromethanesulfonyl)imide $Cu(NTf_2)_2$.

The concentration in metal precursor will be chosen by those skilled in the art according to the surface of the carbon material to be covered and its solubility limit in the ionic liquid. The dissolving of the metal precursor can be facilitated by the adding of a co-solvent (for example, pentane). The co-solvent can then be eliminated via evaporation, for example when placed in a vacuum.

Advantageously, to this mixture may optionally be added an agent to fluidify the reaction medium, by decreasing the viscosity. It can be a salt or the association of an additional ionic liquid.

During the step c), the porous structure is placed in a vacuum. The placing in a vacuum drives the ionic liquid to penetrate into the thickness of the porous structure. Ionic liquids, contrary to an aqueous solution or to a solution containing conventional organic solvents, make it possible to carry out such a step.

The vacuum ranges, for example, from $10^{-10}$ bar to 10 mbar and, preferably, from $10^{-7}$ bar to 10 mbar, and even more preferably from $10^{-5}$ bar to 1 mbar. It is, for example, 0.1 mbar which is about 10 Pa.

The duration of the step of placing in a vacuum can range from a few minutes to a few hours, for example from 2 min to 4 h, preferably from 5 min to 4 h, for example from 5 min to 15 min, or preferably from 10 min to 30 min.

Generally, those skilled in the art can adapt the vacuum and/or the duration of the vacuum according to the different concentrations of reagents, the viscosity of the solution, the interface tension between the ionic liquid and the porous structure, the temperature of the method (the viscosity of the ionic liquid decreases when the temperature increases) which can be brought to 250° C. (according to the stability of the ionic liquid and of the metal precursor), and of the thickness of the porous structure to be impregnated.

During the step d), the impregnated porous structure of the solution is placed in the presence of a hydrogenated reducing agent. This can be gaseous hydrogen, hydrazine, an alcohol, sodium tetrahydridoborate (also called sodium borohydride) or a trialkylsilane, for example with a C1-C6 carbon chain, such as triethylsilane. Preferably, it is gaseous hydrogen. It can be pure hydrogen or a hydrogen/neutral gas mixture, such as $H_2$/Ar.

Alcohols can be, advantageously, used to reduce the most noble metals, such as platinum or palladium, or to reduce copper.

The hydrogenated reducing agent makes it possible to hydrogenate the ligands of the metal complex in order to release the metal, and optionally to reduce the latter when it is at an oxidation state greater than 0. The hydrogenation of the ligands moreover makes it possible to eliminate them easily.

The gaseous hydrogen is, for example, at a pressure ranging from 1 to 10 bars or from 1 to 5 bars. A pressure of 3 bars will be used for example.

Advantageously, this step is carried out at a temperature ranging from 0° C. to 300° C., and preferably from about 20° C. to 300° C., for example from 20° C. to 250° C., and even more preferably from 50° C. to 100° C. When the metal precursor is at an oxidation state 0, lower temperatures can be used, for example it is possible to choose to work at ambient temperature (20-25° C.). A temperature will be chosen that is less than the decomposition temperature of the ligands.

At the end of the method, the ionic liquid can be regenerated. The solution can be reused, which reduces the consumption of reagents.

After the metallisation, the porous structure is extracted from the bath and it is possible to proceed with a new treatment cycle with a new porous structure to be metallised.

According to another alternative, in order to limit the quantity of ionic liquid used, a liquid film can be deposited on the substrate, then heated in a vacuum. The liquid film can then be washed by a solvent at the end of the reaction and the ionic liquid can be recovered by a step of later distillation.

The method can also comprise a later step wherein the metal deposited is oxidised in order to form one or several metal oxides, for example with a step of oxidising annealing.

Non-Limiting Example for the Purposes of Illustration of an Embodiment

In this example, a mat of carbon nanotubes CNTs is fixed on a silicon substrate. The CNTs are, initially, perpendicularly aligned with the substrate (FIG. 1). The CNTs are laid using a metal roller (FIG. 2).

The sample is covered with a solution containing a copper precursor, copper mesitylene (CuMes, 0.05 M), and an ionic liquid, [C1C4Im][NTf2], then placed in a primary vacuum (0.1 mbar) for 2 h. During this step, the ionic liquid does not evaporate. Then, the sample is placed under $H_2$ (3 bars) at 100° C. for 1 h to reduce the copper which is at an oxidation state (I) to metal copper. At the end of the reaction, the ionic liquid is washed several times with dichloromethane.

Figure 3:
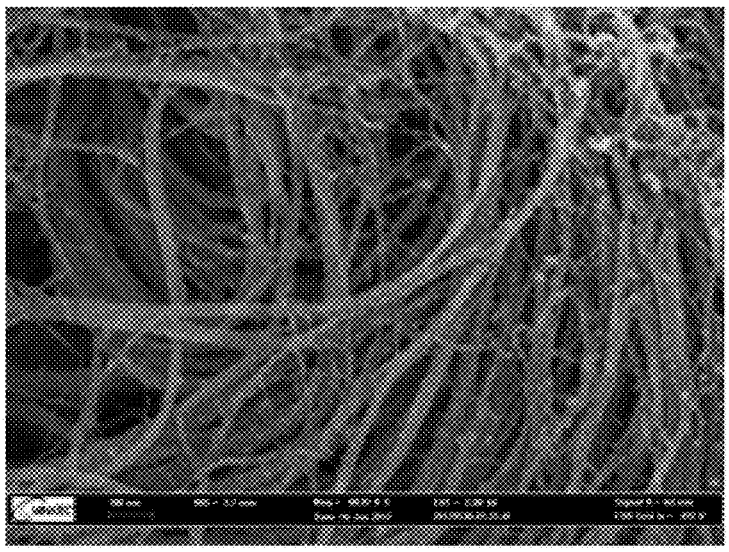
FIG. 3 is a snapshot obtained by scanning electron microscopy, of a top view of a porous structure of carbon nanotubes horizontally aligned on a substrate, after metallisation, according to an embodiment of the method of the invention.
Figure 4A:
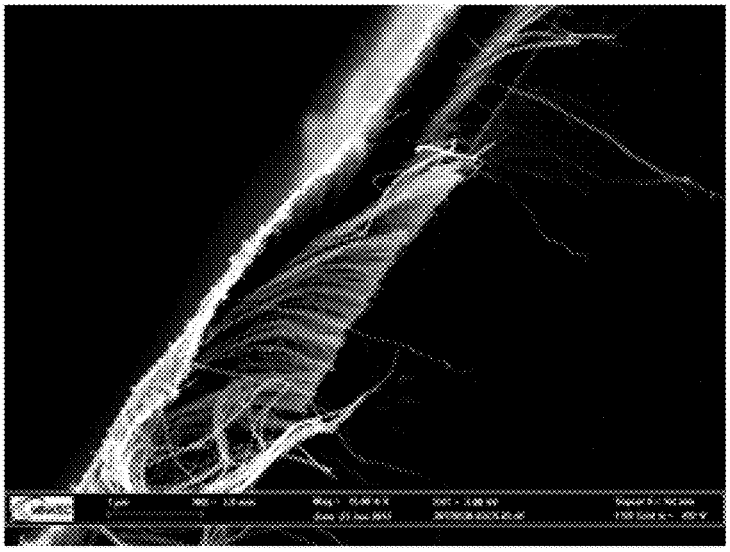
FIGS. 4A and 4B are snapshots obtained by scanning electron microscopy, of a cross-section view, of a porous structure of carbon nanotubes horizontally aligned on a substrate, after metallisation, according to an embodiment of the method of the invention, respectively with a low magnification and a high magnification.
Figure 4B:
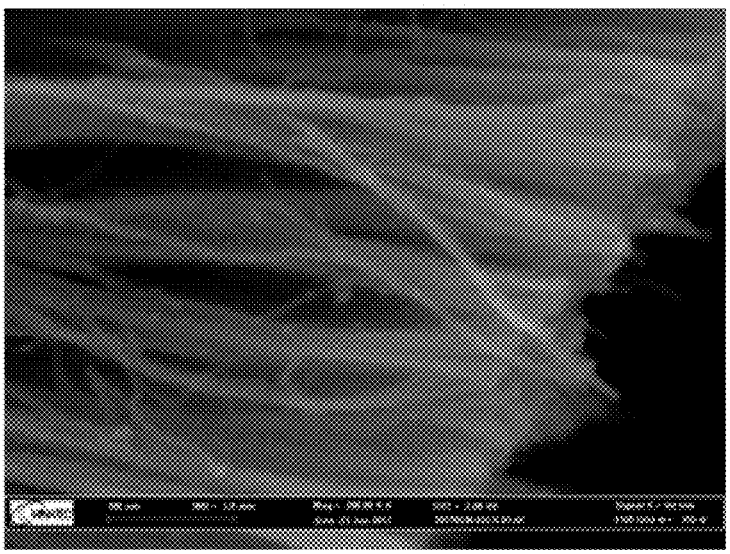

A SEM examination of the mat of CNTs shows the presence of many metal aggregates on the CNTs at the end of the method (FIG. 3). This shows that the CNTs have nucleation sites for the Cu that remain active in the ionic liquid medium. This deposit is present to the base of the CNTs, which proves that the solution was able to penetrate into the thickness of the mat of CNTs (FIGS. 4A and 4B).

The invention claimed is:

1. Method for metallising a porous structure comprising carbon material, said method comprising the following steps:

a) supplying the porous structure comprising the carbon material, the porous structure having pores of 10 nm or less, b) immersing the porous structure in a solution comprising an ionic liquid, formed by a cation and an anion, and a metal precursor, c) placing the porous structure in a vacuum at a pressure ranging from $10^{-7}$ bar to 10 mbar for only the duration of step c), immersed in the solution, in such a way as to cause the solution to penetrate into the porosity of the porous structure, and d) contacting the porous structure immersed in the solution with gaseous hydrogen at a pressure ranging from 1 to 10 bars in such a way as to metallise the porous structure to within the porosity of the porous structure.

2. Method according to claim 1, wherein the metal precursor is a copper, platinum, palladium, ruthenium, nickel, cobalt, iron, tantalum, iridium, rhodium and/or silver precursor.

3. Method according to claim 1, wherein the metal precursor is a metal salt or an organometallic complex.

4. Method according to claim 1, wherein the metal precursor is copper mesitylene.

5. Method according to claim 1, wherein the placing in a vacuum of step c) is carried out for a duration ranging from 2 min to 4 h.

6. Method according to claim 1, wherein the step d) is carried out at a temperature ranging from 0° C. to 300° C.

7. Method according to claim 1, wherein the carbon material is chosen from carbon black, carbon nanofibres, and a mixture of carbon nanotubes and fullerenes.

8. Method according to claim 1, wherein the carbon material comprises carbon nanotubes.

9. Method according to claim 8, wherein the carbon material is consists of carbon nanotubes.

10. Method according to claim 8, wherein the carbon nanotubes are at least partially open.

11. Method according to claim 8, wherein the carbon nanotubes are in the form of a braid.

12. Method according to claim 8, wherein the carbon nanotubes are in the form of a mat, arranged on a substrate, the carbon nanotubes being aligned parallelly or perpendicularly to the substrate.

13. Method according to claim 1, the porous structure having pores of 5 nm or less.

14. Method according to claim 1, the porous structure having pores of 2 nm or less.

15. Method according to claim 1, wherein the carbon material comprises carbon nanotubes and the metal precursor is an organometallic complex.

16. Method according to claim 15, wherein the metal precursor is copper mesitylene.

17. Method according to claim 7, wherein the metal precursor is an organometallic complex.

18. Method according to claim 17, wherein the organometallic complex is copper mesitylene.

19. Method according to claim 5, wherein in step c), the porous structure is placed under vacuum for from 10 min to 30 minutes.

* * * * *